United States Patent [19]

Tolbert et al.

[11] Patent Number: 4,970,981

[45] Date of Patent: Nov. 20, 1990

[54] CHUTE RIVER MINE SWEEP

[75] Inventors: William H. Tolbert; Garrett G. Salsman, both of Panama City, Fla.

[73] Assignee: The United States of America as represented by the Secretary of the Navy, Washington, D.C.

[21] Appl. No.: 756,348

[22] Filed: Aug. 26, 1968

[51] Int. Cl.[5] ..... B63B 21/66; F42B 22/42

[52] U.S. Cl. ..... 114/244; 102/402; 102/415; 114/221 A; 114/243; 114/253

[58] Field of Search ..... 114/16.5, 16.7, 235; 102/7, 15

[56] References Cited

U.S. PATENT DOCUMENTS

| | | | |
|---|---|---|---|
| 2,314,528 | 3/1943 | Temple | 102/415 |
| 2,363,668 | 11/1944 | Groen | 114/244 |
| 2,532,316 | 5/1950 | Larkin | 89/37.16 |
| 2,744,352 | 5/1956 | Holgerson | 114/242 |
| 2,969,036 | 1/1961 | Brown | 114/244 |
| 2,974,627 | 3/1961 | Whipple, Jr. | 114/253 |
| 3,145,617 | 8/1964 | Gondek | 89/1.1 |
| 3,354,860 | 11/1967 | Dale et al. | 114/244 |
| 3,368,514 | 2/1968 | Kelly | 114/243 |

FOREIGN PATENT DOCUMENTS

| | | |
|---|---|---|
| 1137916 | 11/1955 | France . |
| 157285 | 7/1921 | United Kingdom . |

*Primary Examiner*—David H. Brown

*Attorney, Agent, or Firm*—Harvey David; John Becker; Sol Sheinbein

[57] ABSTRACT

A water fillable chute, to be employed as a submerged tractor device is connected to a plurality of wire severing grapnels by means of a metallic chain for sweeping command type river mines.

4 Claims, 2 Drawing Sheets

CHUTE RIVER MINE SWEEP

The invention described herein may be manufactured and used by or for the Government of the United States of America for governmental purposes without the payment of any royalities thereon or therefor.

In recent times it has become necessary to conduct warfare in tropical climes where dense vegetation has limited overland transportation and placed increased reliance upon the many natural watercourses for transportation of personnel and supplies. Such watercourses are vulnerable to being mined by a type of command mine which is moored in the navigable channel and detonated from shore by concealed enemy personnel. Such mines are very effective and, due to their simplicity, may be installed and operated by personnel engaged in espionage activities in occupied territory. The ease with which these mines may be installed and repaired has made frequent sweeping necessary.

Because this type of mine installation may be easily replanted or repaired if the command wire is cut, sweeping operations are only effective if made shortly before the movement of the desired shipping. This removes or diminishes the chance of surprise movements of troops or supplies. The need exists therefore for a sweep system capable of severing any command wires present, and which may be operated without enemy detection.

A variety of sweeping techniques have had varying degrees of success. Most require streaming some type of gear aft of a shallow draft river craft and navigating the channel. The streamed gear severs the command wire to disable or, in some instances, detonate the mine. Operational safety considerations have dictated that the grapneling gear be streamed with a relatively long tow line. The long tow line has been relatively successful in straight channels, however, in curved or sinuous streams, the sweep gear on a long line escapes the channel and leaves critical apex sectors unswept. To use a short tow line or work closer in shore, constitutes a considerable risk to operating personnel by exposing them to point-blank, shore-based gunfire, and their craft to damage by the mine.

In this type of waterway a need has, therefore, existed for an unmanned short tow line sweep capable of working in close to the shore and following the channel around sharp bends. Remotely controlled river craft have been used with moderate success in this capacity. Such craft are not without disadvantage, however. The size and draft of a remotely controlled drone craft of sufficient power to perform sweeping operations is nearly that of its manned counterpart. This size precludes the sweeping oPeration being undetected. Further, the maintenance cost and effort is in excess of a comparable manned craft. Beyond the above disadvantages, the drone boats are expensive to build and deploy in the quantities required.

It is, accordingly, an object of this invention to provide a means and method of sweeping moored command mines which will overcome the aforementioned deficiencies in the prior art.

Further, it is an object of this invention to provide an inexpensive nonrecoverable sweep device to clear curved or sinuous watercourses of command type mines.

Another object of this invention is the provision of a sweeping device which can provide a covert sweep of a watercourse.

The provision of a sweep which is effective in tropical watercourses and may be employed by a minimum commitment of manpower without exposure to enemy gunfire is a further object of this invention.

Other objects and many of the attendant advantages will be readily appreciated as the subject invention becomes better understood by reference to the following detailed description, when considered in conjunction with the accompanying drawings wherein.

Figure 1:
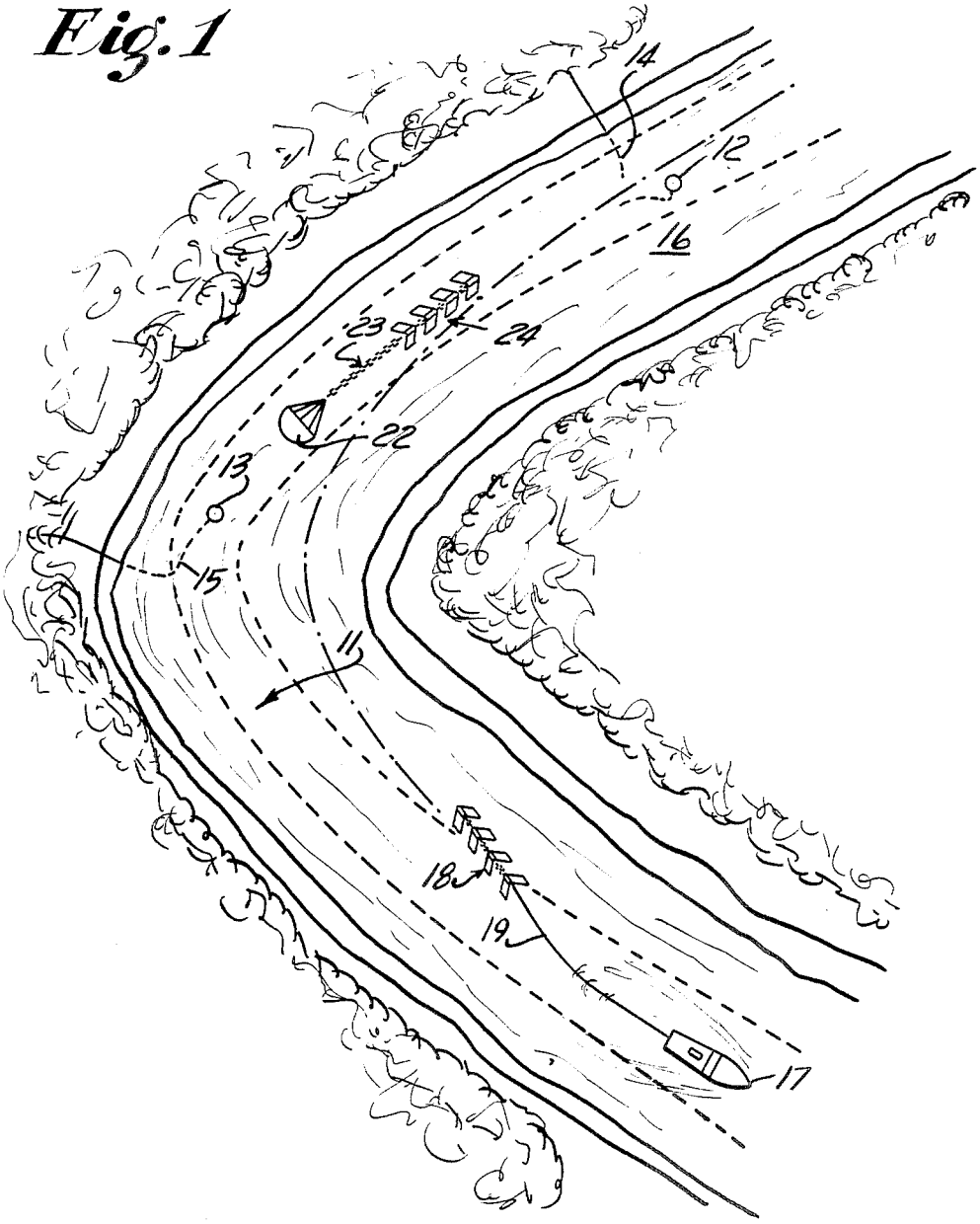
FIG. 1 is a plan view of a typical environment where the invention is practiced.

Referring to FIG. 1 there is shown, in plan view, a typical situation requiring that a navigable channel 11, shown by dotted lines, be cleared of operationally effective command type mines. Two such mines are shown, for purposes of illustration, at 12 and 13. Control wires 14 and 15 connect mines 12 and 13, respectively, and one or more shore based command points concealed along the banks of stream 16. A bend in stream 16 causes the position of channel 11 to be displaced from its normal, central position to a position nearer the outside bank of the bend, in a manner understood by persons versed in hydrography.

A small displacement vessel 17 is shown towing suitable sweep gear 18 via cable 19 in a conventional manner. The trajectory of the sweep gear 18 corresponding to vessel 17 traveling in channel 11 is shown by a broken line 21. As can be seen, the trajectory is such as to successfully sever control wire 14 and thereby neutralize mine 12. When vessel 17, traveling in channel 11, passes through the apex of the bend, the sweep gear is carried out of the channel 11 toward the inside of the bend, thereby missing control wire 15 controlling mine 13 which is placed in the apex portion of the bend in channel 11. This ineffective trajectory is due to the length of tow cable 19. A shorter length of tow cable would permit more accurate tracking of vessel 17 by the sweep gear 18, but at a compromise in the safety of operating personnel of vessel 17. Too, when streamed from a surface vessel, a shorter length of tow cable may not reach deep enough to cut control wires positioned at the usually deeper apex region of a channel bend.

Also shown in FIG. 1 is an embodiment of the present invention to be herein described. In place of vessel 17, a tractor device 22 is employed. A short chain 23 connects tractor device 22 with suitable sweep gear 24. Tractor device 22 may be regarded as an underwater sail or chute which is filled by action of the current of stream 16 and propelled downstream thereby. This reliance upon the current for propulsive force assures that the device will remain within the clear channel portion of the stream.

Figure 2:
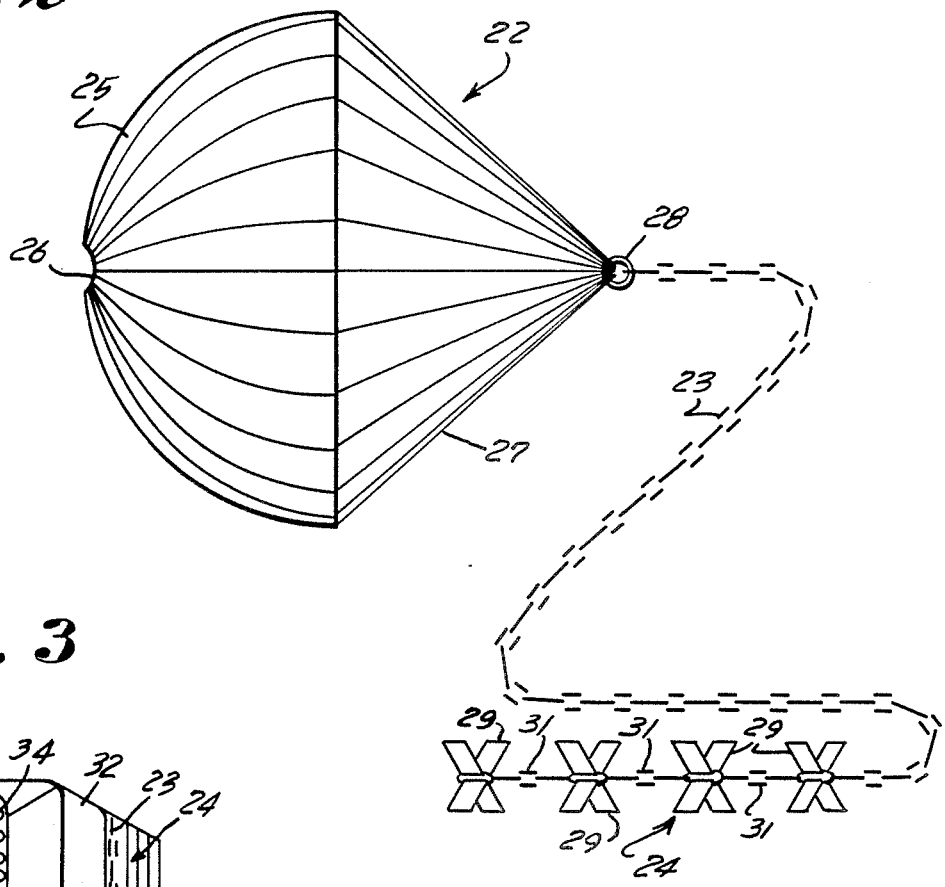
FIG. 2 is an illustration of the device of the invention.

A more accurate showing of the arrangement of the instant invention is seen in FIG. 2. Tractor device 22 is seen to comprise a hydrosail 25 which fills with water under the influence of the current of the stream. An opening 26 aids in the filling of hydrosail 25, as well as stabilization thereof, in the stream current. A plurality of lines 27 spaced about the periphery of hydrosail 25 join it to a tow ring 28. If desired, the plurality of lines 27 may extend over the surface of hydrosail 25 to provide reinforcement therefor. Hydrosail 25 may be circular, as shown in FIG. 2, or other convenient shape as dictated by circumstances. Similarly, opening 26 may be modified in shape, replaced by other opening and stabilization structure, or omitted in accord with the dictates of good design practice as understood by persons skilled in the art.

Any convenient foldable material may be used for hydrosail 25. In general, however, preference is given to materials which are of light weight and high tensel strength. Woven synthetic fibre fabrics have given good experimental results as construction material for hydrosail 25, but suitable sheet plastic materials are applicable as well. Considerations of the visibility in the particular environment may also dictate the choice of material used to construct hydrosail 25.

As noted previously in the description of FIG. 1, a length of chain 23 joins tractor device 22 to suitable sweep gear 24. Inspection of FIG, 2 reveals that chain 23 is connected to the tractor device 22 via tow ring 28. The sweep gear 24, connected to the end of chain 23 remote from tow ring 28, comprises a plurality of grapnels 29 interconnected by suitable connecting devices such as swivels 31. The grapnels 29 may be of any suitable configuration however, the four pronged variety illustrated at FIG. 2 have been found to be effective.

Chain 23, aside from joining sweep gear 24 to tractor device 22, provides sufficient weight to keep the entire assembly submerged and in cooperative relationship with the stream bottom. Under the influence of the motion of hydrosail 25, the sweep gear 24 is towed along the bottom of the stream 16 in the vicinity of channel 11. There, the individual grapnels strike the controlling conductors connected to concealed command mines and sever them by an impact derived cutting force. As previously noted, several configurations of grapnel construction are known in the prior art to be effective. These alternate constructions, when available, may be substituted for illustrated grapnels 29 in accordance with the dictates of experience and the particular preference of persons skilled in the mine sweeping art without departing from the scope of the herein disclosed invention. Likewise, the various illustrated dimensions of chain 23 relative to other dimensions are for purposes of explanation and are susceptible to modifications to suit the parameters of operation.

Figure 3:
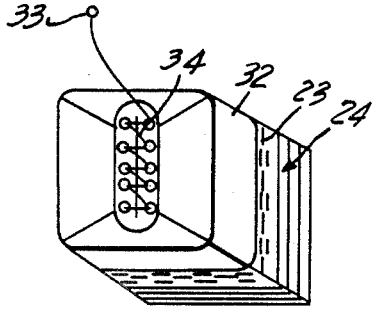
FIG. 3 is a showing how the device of FIG. 2 may be arranged for storage and transportation.

As illustrated in FIG. 3, the entire device of the instant invention may be compactly stored for transportation to the site. Hydrosail 25 is folded and the entire tractor device 22 packed into a disposable fabric bag 32 having an opening 34 closed by lanyard 33 in a manner similar to an aerial parachute. Under opening, fabric bag 32 may fall away from the device, or may be carried therewith, as desired. Chain 23 and sweep gear 24 are compactly stored adjacent to fabric bag 32. As shown, grapnels 29 may be constructed so as to compactly fit together and encase swivels 31 therebetween. The entire assembly or a plurality thereof may be enclosed in a suitable container, not shown, until needed. If desired, each assembly may be tied or otherwise confined by suitable frangible or water soluble bindings. Such bindings would, of course, facilitate the handling and launching of the device but are not necessary to the operation thereof.

Figure 4:
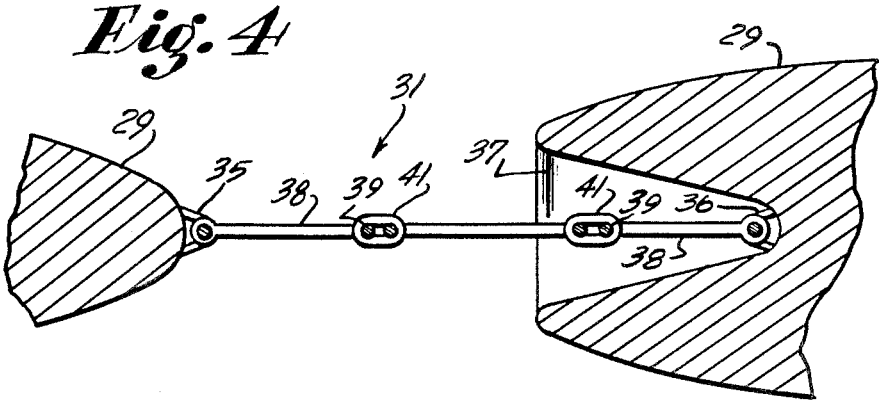
FIG. 4 shows a detail of a portion of the device of FIG. 2.

FIG. 4 illustrates in more detail how the grapnel interconnection might be constructed to facilitate compact storage adjacent to fabric bag 32, as referred to above. The fore and aft portions of two adjacent grapnels 29 are shown in section. An eye 35 on fore portion of one grapnel 29 is joined to an eye 36 in an aft, swivel-receiving recess 37 of an identical grapnel body 29 by a swivel assembly 31. Any of several types of swivel commonly known in marine hardware may be used for swivel 31 and the one herein described should be considered as illustrative only. Two shank portions 38 are joined to eyes 35 and 36 and terminate in heads 39 held in body portions 41 in such a fashion as to permit rotation therewithin. Shank portions 38 may be made of a flexible material such as wire rope, if desired. If a single swivel is desired, only one body portion 41 is used, but, as shown, with the addition of a second body portion 41 and a double headed shank portion 42, a double swivel connection is obtained. It is also possible to incorporate the swivel action into the eyes 35 and 36 and provide interconnection therebetween with a member having limited tortional freedom, such as another length of chain similar to chain 23.

The operation of the device of the invention is quite simple. Personnel transport one or more of the devices to some point upstream of the portion of the stream over which a sweep is desired. There, the device is placed in the channel with the grapnels 29 and chain 23 freed of whatever means was used to secure them for purposes of transportation. Lanyard 33 is pulled, either manually or by securing it to some fixed object and dropping bag 32, chain 23 and sweep gear 24 into the water. Hydrosail 25 requires no assistance in filling in streams with currents as low as one-half knot. The tractor device 22 remains in the channel of swiftest current, i.e., the deepest most navigable channel. After the device or devices have passed a given point the channel may be assumed to be neutralized with respect to command type mines. It should be clear that the device may be transported over land and permits the sweeping of a channel without the use of river craft, adding, thereby, an element of surprise to subsequent movement of water craft in the swept channel. Of course, the device may be used in conjunction with conventional sweeping techniques, as well.

When opened in a stream, hydrosail 25 fills with water and travels downstream pulling chain 23 and sweep gear 24 behind. Meandering streams with currents as low as one-half knot have been swept experimentally with the herein described apparatus. When hydrosail 25 contacts an obstruction, it partially collapses to pass beyond said obstruction and promptly refills under the action of the stream current to continue its downstream passage. The harnessing of the stream current by hydrosail 25 may be compared to the action of a wind sail, a spinnaker for example, in converting the movement of air currents to terrestial vehicle movement.

While the device has been described in relation to river warfare, it should not escape notice that the device has certain utility in harbor warfare as well. Properly designed and installed sweep devices according to the invention may be moved about in a harbor or other shallow offshore area by action of the natural tides or other movement of ocean currents.

From the foregoing, it is seen that Applicant has provided a new and useful device for sweeping command type mines. The device of the invention may be used close inshore in navigable streams without exposing operating personnel of surface craft to shore based gunfire. The device is capable of sweeping the navigable channel of a sinuous stream with greater fidelity than can be readily accomplished with surface tractor ships and, in general, satisfies the objects of the invention.

Obviously, other embodiments and modifications of the subject invention will readily come to the mind of one skilled in the art and having the benefit of the teachings presented in the foregoing description and the drawings. It is, therefore, to be understood that this invention is not to be limited thereto and that said modifications and embodiments are intended to be included within the scope of the appended claims.

What is claimed is:

1. A minesweeping device for neutralizing command type mines located within a body of water having water currents flowing therein comprising:

circular hydrosail means made of a woven synthetic fabric having low visibility within said body of water for cooperating with said water current in such a manner as to derive a propulsive force therefrom;

central aperture means within said hydrosail for stabilizing said hydrosail in said water current;

a plurality of coupling line means joined to said circular hydrosail and spaced about the circumference thereof for attaching implements thereto;

flexible towing means attached at one end to said plurality of coupling line means in such a fashion as to be towed thereby upon movement of said hydrosail means by said water current; and grapnel means having sufficient weight to rest on the bottom of said body of water and attached to said flexible towing means at the end remote from said plurality of coupling line means for severing control wires attached to said command mines and for lying on the bottom of said body of water upon contact therewith.

2. A mine sweeping device according to claim 1 further comprising:

recess means in the aft end of each of said grapnel means for providing an enclosure therein;

aft eye means within the recess means for providing attachment means therewith;

foreward eye means on the fore portion of each grapnel means for providing an attachment point thereon; and swivel means connected between said foreward and aft eye means of adjacent ones of said grapnels for permitting axial rotation thereof while transmitting towing force therebetween and constructed in such a manner as to be enclosed within said recess means when said mine sweeping device is not in use.

3. A mine sweeping device according to claim 1 further comprising:

closed metal ring means connected between said plurality of coupling line means and said flexible towing means for transmitting a towing force therebetween.

4. A mine sweeping device according to claim 3 in which said flexible towing means comprises a length of metallic chain.

* * * * *